US005125373A

United States Patent [19]

Yamada et al.

[11] Patent Number: 5,125,373

[45] Date of Patent: Jun. 30, 1992

[54] OIL PASSAGE STRUCTURE FOR ROCKER-ARM SHAFT FOR INTERNAL COMBUSTION ENGINE

[75] Inventors: Yoshihiko Yamada; Seinosuke Hara; Shoji Morita, all of Kanagawa, Japan

[73] Assignee: Atsugi Unisia Corporation, Kanagawa, Japan

[21] Appl. No.: 765,124

[22] Filed: Sep. 25, 1991

[30] Foreign Application Priority Data

Sep. 26, 1990 [JP] Japan ..... 2-256636

[51] Int. Cl.[5] ..... F01M 9/10

[52] U.S. Cl. ..... 123/90.36; 123/196 M

[58] Field of Search ..... 123/90.33, 90.36, 196 R, 123/196 M

[56] References Cited

U.S. PATENT DOCUMENTS

| | | | |
|---|---|---|---|
| 4,615,310 | 10/1986 | Umeha et al. | 123/90.33 |
| 4,630,576 | 12/1986 | Raymond | 123/90.36 |
| 4,662,323 | 5/1987 | Moriya | 123/90.36 |
| 4,807,574 | 2/1989 | Shibata et al. | 123/90.36 |

FOREIGN PATENT DOCUMENTS

| | | | |
|---|---|---|---|
| 0106306 | 5/1988 | Japan | 123/90.36 |

*Primary Examiner*—Tony M. Argenbright
*Assistant Examiner*—Weilun Lo
*Attorney, Agent, or Firm*—Bachman & LaPointe

[57] ABSTRACT

An oil passage structure for a rocker-arm shaft for an internal combustion engine, comprises an outer cylindrical member for rotatably supporting rocker arms and an inner cylindrical member press-fitted into the outer cylindrical member. The inner cylindrical member employs at least one concavity having a given axial length for defining at least two axial oil passages.

6 Claims, 2 Drawing Sheets

OIL PASSAGE STRUCTURE FOR ROCKER-ARM SHAFT FOR INTERNAL COMBUSTION ENGINE

BACKGROUND OF THE INVENTION

1. Field of the Invention

The present invention relates generally to a rocker-arm shaft for internal combustion engines and specifically to an oil passage structure for a rocker-arm shaft rotatably supporting a rocker arm for internal combustion engines.

Description of the Prior Art

As is well known, there have been disclosed various rocker-arm shafts employing an oil lubricating system through which lubricant is supplied to a rocker arm of an internal combustion engine so as to insure a smooth movement of the rocker arm. As seen in FIGS. 1 and 2, a conventional rocker-arm shaft A includes a plurality of axial oil passages 20 and 21 communicated with a main oil gallery and a plurality of radial oil passages 22 communicated with either the axial o passages 20 or 21 for the purpose of oil supply to an oscillating portion of each engine rocker arm (not shown). In such a conventional rocker-arm shaft, axial oil passages 20 and 21 are disposed in parallel with each other to reliably feed lubricating oil to each radial oil passage employed to an oscillating portion of each rocker arm as clearly shown n FIG. 1. As is generally known, it is difficult to provide a high straightness of an axial oil passage by machining. If adjacent axial oil passages are extremely long, there is a possibility that the adjacent oil passages interfere with each other. Moreover, there is a possibility that these axial oil passages penetrate through an outer surface of the rocker-arm shaft. For this reason, there have been disclosed and developed various techniques with regard to an oil passage structure for a rocker-arm shaft. One such prior art oil passage structure has been disclosed in Japanese First Publication Tokkai (Showa) 63-57805. The conventional oil passage structure for a rocker-arm shaft includes a X-shaped or Y-shaped thin-plate partition member press-fitted into a hollow rocker-arm shaft to define a plurality of axial oil passages in the hollow rocker-arm shaft. This conventional oil passage structure can eliminate the aforementioned problem of a high accuracy of machining, such as drilling, required to provide a high straightness of the axial oil passage. However, in the previously described conventional oil passage structure for a rocker-arm shaft employing such a thin-plate partition member provides a relatively small contact area between an inner wall of a hollow rocker-arm shaft and edges of the thin-plate partition member. It is difficult to provide a reliable press-fitting between the partition member and the rocker-arm shaft. This results in oil leakage between adjacent axial oil passages defined by the thin-plate partition member press-fitted into the rocker-arm shaft. In other words, the conventional oil passage structure cannot assure a high sealing characteristics with regard to a partition member and insure reliable oil supply to an oscillating portion of each engine rocker arm. Furthermore, the above noted X-shaped or Y-shaped thin-plate partition member requires a difficult skilled manufacturing process and a hard dimensional tolerance.

SUMMARY OF THE INVENTION

It is, therefore, in view of the above disadvantages, an object of the present invention to provide an oil passage structure for a hollow rocker-arm shaft for an internal combustion engine, which can reliably provide a desired oil supply amount to an oscillating portion of an engine rocker arm.

It is another object of the invention to provide an oil passage structure for a hollow engine rocker-arm shaft which can easily provide a high dimensional tolerance with regard to a plurality of oil passages.

It is a further object of the invention to provide an oil passage structure for a hollow engine rocker-arm shaft which can completely prevent an oil leakage between adjacent axial oil passages defined in the hollow rocker-arm shaft.

In order to accomplish the aforementioned and other objects, an oil passage structure for a rocker-arm shaft for an internal combustion engine, comprises an outer cylindrical member for rotatably supporting a rocker arm and an inner cylindrical member press-fitted into the outer cylindrical member. The inner cylindrical member employs at least one concavity having a given axial length for defining at least two axial oil passages. One of the at least two axial oil passages is defined by an inner wall of the inner cylindrical member and another axial oil passage is defined by an inner peripheral surface of the outer cylindrical member and the concavity employed on the inner cylindrical member. The inner and outer cylindrical members are in contact with each other with a curved surface contact. The outer cylindrical member may preferably include a closed end and an opening end and in addition the inner cylindrical member may include a closed end and an opening end. The closed end of the inner cylindrical member may be easily press-fitted through the opening end of the outer cylindrical member into the outer cylindrical member. The closed end of the inner cylindrical member is preferably mated with the closed end of the outer cylindrical member so as to provide a precise and easy positioning between the inner and outer cylindrical members.

DESCRIPTION OF THE PREFERRED EMBODIMENTS

Figure 1:
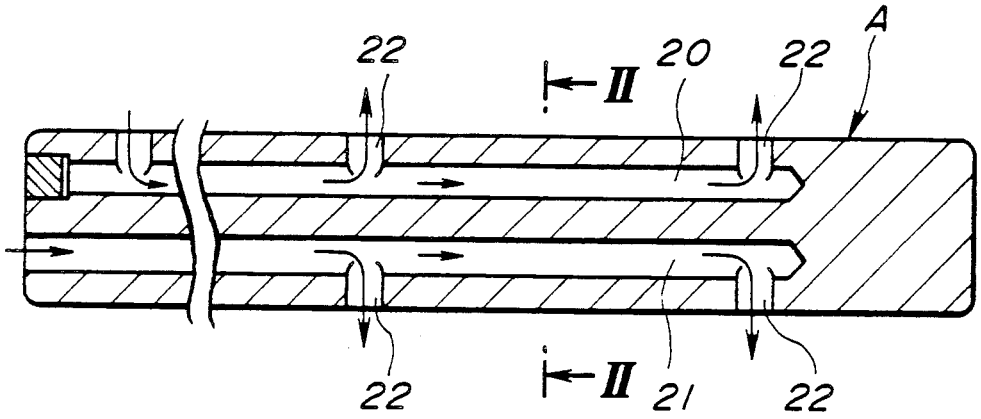
FIG.1 (PRIOR ART)
FIG. 1 is a longitudinal cross-sectional view illustrating an oil passage structure of a prior art rocker-arm shaft for an internal combustion engine.
Figure 2:
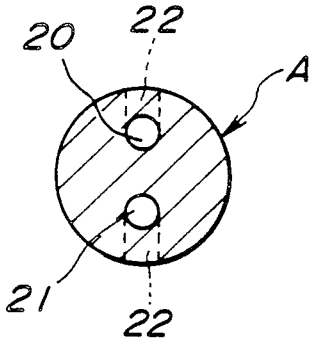
FIG.2 (PRIOR ART)
FIG. 2 is a lateral cross-sectional view illustrating an oil passage structure of the conventional rocker-arm shaft of FIG. 1.
Figure 3:
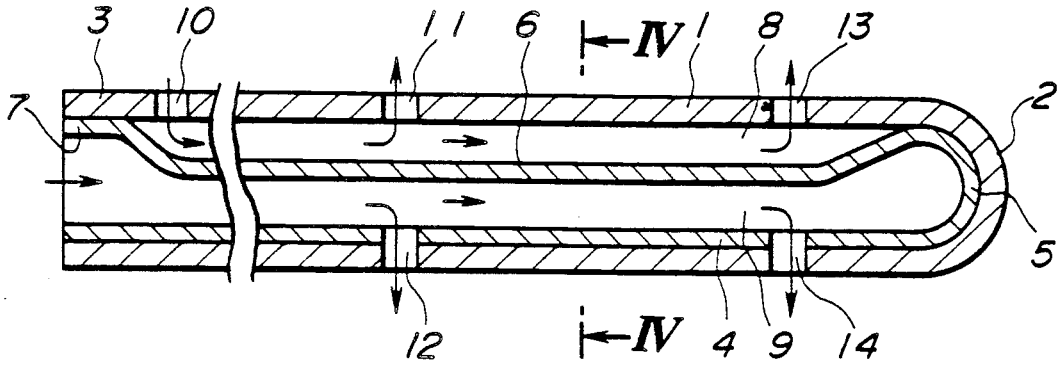
FIG. 3 is a longitudinal cross-sectional view illustrating an oil passage structure of a preferred embodiment of an engine rocker-arm shaft according to the present invention.
Figure 4:
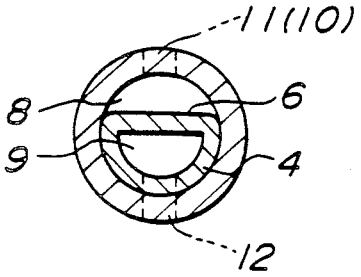
FIG. 4 is a lateral cross-sectional view illustrating the oil passage structure of FIG. 3.

Referring now to FIGS. 3 and 4, a hollow rocker-arm shaft according to the invention is comprised of an outer cylindrical member and an inner cylindrical or tubular member 4. The outer cylindrical member 1 has both ends, one being a semi-spherical closed end 2 and the other being an opening end 3. On the other hand, the inner cylindrical member 4 has a semi-spherical closed end 5 and an opening end 7. Note that the inner cylindrical member 4 is press-fitted through the opening end 3 into the inner side of the outer cylindrical member 1 in such a manner that the two semi-spherical ends 2 and 5 are mated with each other in a water-tight fashion. The inner cylindrical member 1 employs a concavity 6 having a given axial length. In the rocker-arm shaft according to the preferred embodiment, both closed ends 2 and 5 are fixed to each other by means of brazing and in addition both opening ends 3 and 7 are also fixed to each other by means of brazing, so as to reliably prevent a relative movement between both outer and inner cylindrical members 1 and 4. In this manner, when the inner cylindrical member 4 is press-fitted into the outer cylindrical member 1, axial oil passages 8 and 9 are defined by the inner wall surface of the outer cylindrical member 1 and the concavity 6 of the inner cylindrical member 4. In addition to the axial oil passages 8 and 9, radial oil passages 10, 11, 12, 13 and 14 each of which communicates either the axial oil passages 8 and 9, are bored either in desired sections of the outer cylindrical member 1 or in desired common sections of both outer and inner cylindrical members 1 and 4. In the present embodiment, both the opening end 7 of the inner cylindrical member 4 and the radial oil passage 10 are connected to a main oil gallery (not shown). In this construction, lubricating oil fed from the main oil gallery is supplied through two different oil passageways, one being a first oil passageway reaching from the radial oil passage 10 through the axial oil passage 8 to the radial oil passages 1 and 13 and the other being a second oil passageway reaching from the opening end 7 through the axial oil passage 9 to the radial oil passages 12 and 14. Subsequently, lubricating oil discharged from each of the radial oil passages 11, 12, 13 and 14 is supplied to each oscillating portion of a plurality of rocker arms.

As will be appreciated from the above, an oil passage structure according to the invention can provide a plurality of oil passages having various cross-sectional area by selecting one of inner cylindrical members employing various concavities defining the respective inherent cross-sections in conjunction with the inner peripheral wall of the outer cylindrical member 1. Furthermore, an improved oil passage structure for the rocker-arm shaft according to the invention can eliminate a drilling as required in the previously described conventional oil passage structure. Actually, the inner cylindrical member 4 of the present embodiment functions as a partition member as disclosed in the Japanese First Publication Tokkai (Showa) 63-57805. Since such an inner cylindrical member 4 can be easily and accurately manufactured, the inner cylindrical member 4 can be precisely press-fitted into the outer cylindrical member 1. Since both members 1 and 4 are cylindrical, the cylindrical members 1 and 4 are in contact with each other over a relatively wide curved contact surface. Therefore, the oil passage structure of the embodiment can provide a high sealing characteristics between two passageways, namely a first passageway defined by the inner peripheral surface of the outer cylindrical member 1 and the outer peripheral surface of the inner cylindrical member 4 and a second passageway defined by the inner peripheral surface of the inner cylindrical member 4. This results in a reliable oil supply amount with a given volumetric discharge to an oscillating portion of an engine rocker arm. According to the present embodiment, since the closed end 5 of the inner cylindrical member 4 is semi-spherical, the inner cylindrical member 4 may be easily press-fitted into the outer cylindrical member 1. In addition, since the inner cylindrical member 4 is positioned in relation to the outer cylindrical member 1 in such a manner as to mate the closed end 5 with the closed end 2, the positioning between the two cylindrical members 1 and 4 is easy and precise and the assembling time of the members 1 and 4 is reduced. As set forth above, an oil passage structure according to the invention can provide a high manufacturing efficiency of the rocker-arm shaft having a lubricating function for rocker arms.

Figure 5:
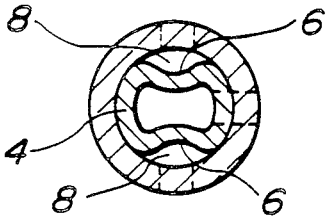
FIG. 5 is a lateral cross-sectional view illustrating an oil passage structure of a rocker-arm shaft of a second embodiment.

Although in the previously noted first embodiment, the inner cylindrical member 4 includes one concavity 6, at least two concavities may be employed on the inner cylindrical member 4 to provide numerous axial oil passages, as shown in FIG. 5. By selection of the number of the concavity formed on the inner cylindrical member 4, a desired number of oil passages can be achieved. When compared with the previously described X-shaped or Y-shaped thin-plate partition member, concavities of an inner cylindrical member 4 can be easily and precisely formed thereon.

Figure 6:
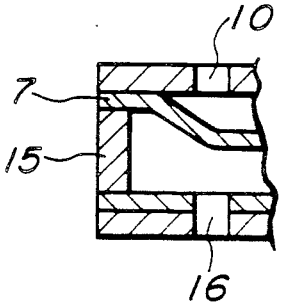
FIG. 6 is a partial cross-sectional view illustrating an oil passage structure of a rocker-arm shaft of a third embodiment.

Furthermore, in the first embodiment, although the opening end 7 of the inner cylindrical member 4 is connected to the main oil gallery (not shown), the opening end 7 may be closed by means of a blind lid 15 and alternatively a newly added radial oil passage 16 may be bored in the common location of both the inner and outer cylindrical members 1 and 4 in a manner so as to communicate the radial oil passage 6 with the main oil gallery, as shown in FIG. 6.

Moreover, in the preferred embodiment, although both outer and inner members 1 and 4 are fixed to each other by means of brazing, both members 1 and 4 may fixed only by press-fitting.

While the foregoing is a description of the preferred embodiment for carrying out the invention, it will be understood that the invention is not limited to the particular embodiment shown and described herein, but may include variations and modifications without departing from the scope or spirit of this invention as described by the following claims.

What is claimed is:

1. An oil passage structure for a rocker-arm shaft for an internal combustion engine, comprising:

an outer cylindrical member for rotatably supporting a rocker arm; and an inner cylindrical member press-fitted into said outer cylindrical member, said inner cylindrical member employing at least one concavity having a given axial length for defining at least two axial oil passages.

2. The oil passage structure as set forth in claim 1, wherein one of said at least two axial oil passages is defined by an inner wall of said inner cylindrical member and another axial oil passage is defined by an inner peripheral surface of said outer cylindrical member and said concavity employed on sad inner cylindrical member.

3. The oil passage structure as set forth in claim 1, wherein said inner and outer cylindrical members are in contact with each other with a curved surface contact.

4. The oil passage structure as set forth in claim 1, said outer cylindrical member includes a closed end and an opening end and said inner cylindrical member includes a closed end and an opening end, and said inner cylindrical member is press-fitted through the opening end of said outer cylindrical member into said outer cylindrical member.

5. The oil passage structure as set forth in claim 4, wherein said inner cylindrical member is positioned in relation to said outer cylindrical member in such a manner as to mate the closed end of said inner cylindrical member with the closed end of said outer cylindrical member.

6. The oil passage structure as set forth in claim 1, wherein said inner cylindrical member is replaced with an inner tubular member.

* * * * *